US007437894B1

(12) United States Patent
Lagueux

(10) Patent No.: US 7,437,894 B1
(45) Date of Patent: Oct. 21, 2008

(54) CIRCULAR KNITTING MACHINE WITH FABRIC SCANNER, AND BREAK-AWAY MOUNT FOR FABRIC SCANNER

(75) Inventor: Raymond Lucien Lagueux, Matthews, NC (US)

(73) Assignee: Monarch Knitting Machinery Corp., Bronx, NY (US)

( * ) Notice: Subject to any disclaimer, the term of this patent is extended or adjusted under 35 U.S.C. 154(b) by 0 days.

(21) Appl. No.: 11/769,330

(22) Filed: Jun. 27, 2007

(51) Int. Cl.
*D04B 9/00* (2006.01)

(52) U.S. Cl. ..... 66/8

(58) Field of Classification Search ..... 66/8, 66/13, 150, 151, 152, 153
See application file for complete search history.

(56) References Cited

U.S. PATENT DOCUMENTS

| | | | | |
|---|---|---|---|---|
| 2,991,639 | A | 7/1961 | Meiners et al. | |
| 3,345,836 | A * | 10/1967 | Fertig et al. | 66/166 |
| 3,417,252 | A | 12/1968 | Nickell et al. | |
| 4,748,334 | A * | 5/1988 | Kobayashi et al. | 250/559.42 |
| 4,984,896 | A * | 1/1991 | Flamig | 356/429 |
| 5,133,198 | A * | 7/1992 | Bachmann | 66/166 |
| 5,283,623 | A * | 2/1994 | Muhlberg et al. | 356/430 |
| 5,285,663 | A | 2/1994 | Taniguchi | |
| 5,697,480 | A | 12/1997 | Herbermann et al. | |
| 5,954,446 | A | 9/1999 | Ireland | |
| 6,129,476 | A | 10/2000 | Berman et al. | |
| 6,219,136 | B1 | 4/2001 | Kuo et al. | |
| 6,346,751 | B1 | 2/2002 | Delfino et al. | |
| 6,847,181 | B2 | 1/2005 | Brooks et al. | |
| 7,114,406 | B2 | 10/2006 | Wright et al. | |

* cited by examiner

*Primary Examiner*—Danny Worrell
(74) *Attorney, Agent, or Firm*—Alston & Bird LLP

(57) ABSTRACT

A break-away mount for mounting a fabric scanner to the central support shaft in a circular knitting machine. The mount normally fixes the scanner in a stationary position on the end of a mounting arm of the mount, but if sufficient force is exerted on the scanner in the direction of movement of the fabric, the mount breaks away and allows the scanner to rotate about the support shaft so that the scanner can move along with the fabric. If the amount of such rotational movement exceeds a predefined value, then the break-away mount also releases the mounting arm so that the mounting arm can pivot about a non-vertical axis to allow the scanner to descend with the descending fabric tube. By detecting the breaking away of the mount, the knitting machine can be stopped in time to prevent damage to the scanner and mount.

21 Claims, 4 Drawing Sheets

CIRCULAR KNITTING MACHINE WITH FABRIC SCANNER, AND BREAK-AWAY MOUNT FOR FABRIC SCANNER

BACKGROUND OF THE INVENTION

The present disclosure relates generally to circular knitting machines, and more particularly to circular knitting machines having a fabric scanner mounted for contacting an inner surface of the fabric tube being knitted in order to detect defects such as holes in the fabric.

In a circular knitting machine, a tubular fabric is continuously knitted from a plurality of separate yarns. The tubular fabric potentially can include defects from various causes, and if a defect appears, it can be of a recurring type that will continue to be produced repeatedly. Accordingly, it is advantageous to be able to detect defects so that the machine can be stopped and the cause of the defect found and corrected before further production is resumed.

It is common practice to include a fabric scanner for scanning the fabric to detect defects. For example, it is known to mount a scanner on an arm that is affixed to a hub mounted on a vertical central shaft that extends down the center of the knitting machine. The tubular fabric also rotates about the axis of the shaft as it is being knitted. The tubular fabric thus moves in a screw-type fashion (i.e., both rotating and translating). However, the hub of the scanner mount does not rotate, and thus the scanner is fixed in one position. The scanner is long enough in the axial direction so that any defect will pass directly in front of the scanner at least once as the tubular fabric rotates.

Typically, the scanner actually contacts the inside surface of the fabric tube. Some defects (e.g., holes) can be of a nature that can cause the fabric to snag on the scanner. If this happens, the fabric can exert enough force on the scanner to damage it or its mount.

BRIEF SUMMARY OF THE DISCLOSURE

The present disclosure relates to a break-away mount for mounting a fabric scanner to the central support shaft in a circular knitting machine. The mount normally fixes the scanner in a stationary position on the end of a mounting arm of the mount, but if sufficient force is exerted on the scanner in the direction of movement of the fabric, the mount breaks away and allows the mounting arm to rotate about the support shaft so that the scanner can move along with the fabric. By detecting the breaking away of the mount, the knitting machine can be stopped in time to prevent damage to the scanner and mount.

In one embodiment, if the amount of rotational movement of the mounting arm exceeds a predefined value, then the break-away mount also releases the mounting arm so that the mounting arm can pivot about a non-vertical axis to allow the scanner to descend with the descending fabric tube.

Various mechanical arrangements can be used for providing the break-away functionality, and the invention is not limited to any particular mechanism. However in one embodiment, a break-away mount comprises a revolving section and a stationary section, the scanner being fixed to the revolving section so as to rotate therewith when the break-away mount breaks away, the stationary section being rigidly affixed to the support shaft. The revolving section is rotatable relative to the stationary section about a generally vertical axis that generally coincides with the axis of the support shaft. A first break-away mechanism normally restrains the revolving section from rotating relative to the stationary section.

The first break-away mechanism is operable such that if sufficient force is exerted on the scanner in the rotational direction, the first break-away mechanism breaks away and allows the revolving section to rotate about the generally vertical axis.

In one embodiment, the first break-away mechanism comprises one or more spring-biased plungers mounted on one of the stationary and revolving sections, each plunger being biased by a spring force such that an end of the plunger engages a corresponding recess in the other of the stationary and revolving sections. A periphery of each recess is formed as a ramped surface, whereby the first break-away mechanism breaks away when sufficient force is exerted on the scanner in the rotational direction to overcome the spring force biasing each plunger such that the end of each plunger rides up the ramped surface and out of the corresponding recess, whereupon the revolving section is free to rotate.

In one embodiment, the mounting arm is prevented from pivoting relative to the revolving section by a second break-away mechanism structured and arranged to allow a predefined amount of rotational movement of the revolving section relative to the stationary section before the second break-away mechanism releases or breaks away. Once the second break-away mechanism breaks away, it allows the mounting arm to pivot about a non-vertical axis. Thus, the break-away mount has a first break-away mechanism that is force-based (i.e., breaking away occurs when a force or moment threshold is exceeded) to allow the mounting arm to rotate about a generally vertical axis, and a second break-away mechanism that is displacement-based (i.e., breaking away occurs when a predetermined rotational movement is exceeded) to allow the mounting arm to pivot about the non-vertical axis.

In one embodiment, the second break-away mechanism comprises a latch and a pin. The latch is affixed to one of the revolving and stationary sections and the pin is affixed to the other of the revolving and stationary sections. The latch has a slot in which the pin is engaged to prevent the mounting arm from pivoting about the non-vertical axis. The latch and pin are arranged such that when the revolving section breaks away and begins to rotate, the pin relatively moves within the slot until said predefined amount of rotational movement is exceeded such that the pin comes out of the slot, the mounting arm then being free to pivot about the non-vertical axis.

The break-away mount can further comprise a stop member for limiting much the mounting arm can pivot about the non-vertical axis. In one embodiment, the stop member is adjustable in position for adjusting how far the mounting arm can pivot about the non-vertical axis.

In one embodiment, the mounting arm comprises a two-bar linkage, a first bar of the linkage being connected to the revolving section, a second bar of the linkage being pivotally connected to the first bar and the scanner being mounted on the end of the second bar. The mounting arm can further comprise a spring mechanism that urges the second bar to pivot relative to the first bar so as to press the scanner against the inner surface of the fabric tube.

In one embodiment, the mounting arm is connected to the revolving section by an adjustable connection so that the mounting arm can be adjusted radially for accommodating fabric tubes of different diameters.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
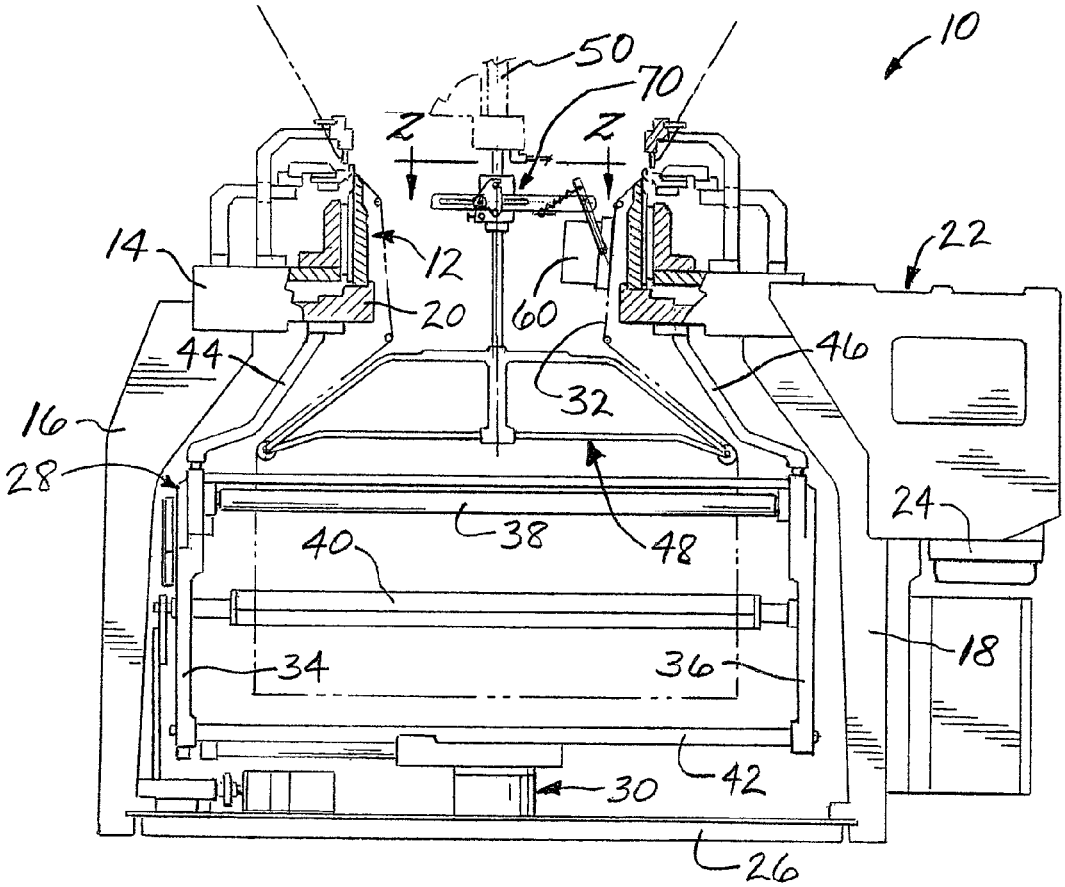
FIG. 1 is a diagrammatic view of a circular knitting machine with a fabric scanner mounted in accordance with an embodiment of the invention.
Figure 4:
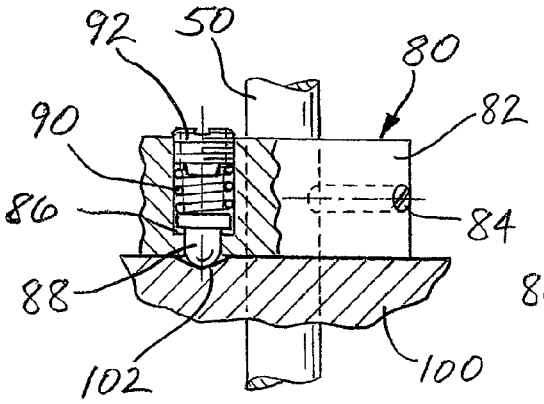
FIG. 4 is a cross-sectional view along line 4-4 in FIG. 2, showing a spring-loaded plunger of the mounting arrangement.
Figure 5:
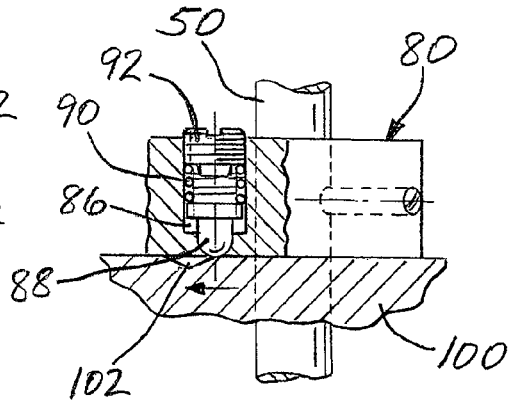
FIG. 5 is a cross-sectional view along line 5-5 in FIG. 3, showing the spring-loaded plunger having been unseated from the recess in the stationary section of the mounting arrangement.

FIG. 1 of the drawings shows a circular knitting machine 10 that includes a knitting unit 12 disposed above a generally annular bed 14 supported by a plurality of upstanding legs 16, 18 of the frame of the knitting machine. The knitting unit 12 is connected to and rotatable with a large diameter ring gear 20 supported by the bed 14 and driven by a driving unit 22 having a motor 24.

A support member 26 interconnecting lower end portions of legs 16, 18 stabilizes the legs and supports a rotatable fabric winding unit 28 for rotation about the vertical axis of a support member 30 mounted upon and located centrally of the support member 26. Guard nets (not shown) are disposed between legs 16, 18, and one of the nets has a movable gate through which rolls of tubular knitted fabric 32 are removed from the machine 10.

The fabric winding unit 28 located within the lower part of machine includes a rotating frame formed in part by opposite side frame members 34, 36 between which extend a plurality of rotatable fabric delivery rolls 38 and a rotatable fabric winding shaft 40. Structrual cross members 42 interconnect the side frame members 34, 36. The rotatable frame is connected to member 30 and is rotatable upon its vertical central axis. Drive bars 44, 46 connected to and extending downwardly from the gear 20 to side frame members 34, 36 rotate the unit 28 in synchronized relationship to rotation of gear 20.

Thus, tubular fabric 32 is knitted by the knitting unit 12 and descends therefrom. As the tubular fabric is knitted, the fabric tube is rotating about the vertical central axis at the rate of rotation of the gear 20, and hence the fabric winding unit 28 rotates along with and in synchronized relationship to the tubular fabric 32. A fabric stretching and flattening device 48 is disposed within the fabric tube above the fabric delivery rolls 38 for flattening the fabric tube so that it can be wound into a roll about the winding shaft 40.

The knitting machine includes a vertical central support shaft 50 that supports (among other things) a fabric scanner 60. The fabric scanner is operable to detect defects in the knitted fabric 32, such as holes caused by missed stitches. Such holes typically are a result of one or more broken needles in the knitting unit 12. If a condition such as a broken needle is not corrected, then the fabric will continue to be produced with defects. Accordingly, fabric defects must be detected as soon as possible so that the machine can be stopped and checked to determine whether there is an abnormal condition requiring correction. Fabric scanners for detecting defects in circular knit fabric are per se known, and thus do not require detailed description herein. It is sufficient to note that the scanner 60 is positioned to contact the inner surface of the tubular fabric 32, such that the fabric slides over the face of the scanner as the rotating fabric tube descends to the winding unit 28. The scanner operates on an optical principle for detecting defects as the fabric moves across the face of the scanner. The face of the scanner is sufficiently long in the axial direction (top to bottom in FIG. 1) such that a defect at a single circumferential location in the tubular fabric will be guaranteed to pass across the face of the scanner as the fabric tube moves in screw fashion (i.e., with both rotational and axial components of movement). In particular, the face of the scanner should be at least as long in the axial direction as the pitch of the fabric tube (where pitch is defined as the axial distance traveled by a given point on the tube for one complete revolution of the point about the tube's axis). More typically, fabric scanners are "oversized" such that a given point on the fabric tube will pass across the face of the scanner two or more times. In any event, the details of the fabric scanner per se are not particularly pertinent to the present disclosure.

When the fabric tube includes one or more hole defects, there is a possibility that the hole can snag on the scanner 60 as the fabric slides over it. This can cause the fabric to exert a relatively large amount of force on the scanner. For fixedly mounted scanners, the force can break or damage the scanner or its mounting mechanism. The present disclosure concerns an improved mounting arrangement for fabric scanners in circular knitting machines.

With reference to FIG. 1, the scanner 60 is mounted on the support shaft 50 by a break-away mount 70. The break-away mount is illustrated in detail in FIGS. 2 through 7. The mount includes a stationary section 80 and a revolving section 100. The stationary section 80 is secured to the support shaft 50 in a fixed manner, and the revolving section 100 is engaged with the stationary section in a manner permitting the revolving section to rotate about an axis that substantially coincides with the axis of the support shaft 50. The mount includes break-away features that prevent the revolving section from rotating under normal conditions, but permit the revolving section to break away and begin rotating when sufficient moment is exerted on the rotating section, as further described below.

A mounting arm 120 is secured to the revolving section 100 and extends generally radially outwardly therefrom toward the inner surface of the fabric tube 32 descending from the knitting unit 12. The fabric scanner 60 is mounted on the arm 120. The arm 120 comprises a two-bar linkage having a first bar 122 that is affixed to the revolving section 100 and a second bar 124 that is pivotally connected to the outer end of the first bar 122 via a pivot pin 126 extending through a hole in the first bar 122 and through holes in the second bar 124. The second bar 124 is actually a U-shaped yoke having a pair of parallel spaced legs 128 that have the holes for the pivot pin 126. The scanner 60 is mounted between the legs 128. The scanner includes a conventional wire fabric guard 62 extending generally "upstream" from the scanner in the circumferential and axial directions to prevent the fabric 32 from snagging on the mounting arrangement for the scanner. A spring 130 is connected between the first bar 122 and the second bar 124 and exerts a tension force on the end of the second bar 124 on the opposite side of the pivot pin 126 from the end of the second bar 124 that supports the scanner 60. The spring 130 urges the second bar 124 to pivot in a direction to press the fabric scanner 60 against the inner surface of the fabric tube 32, as shown for example in FIG. 6.

Figure 6:
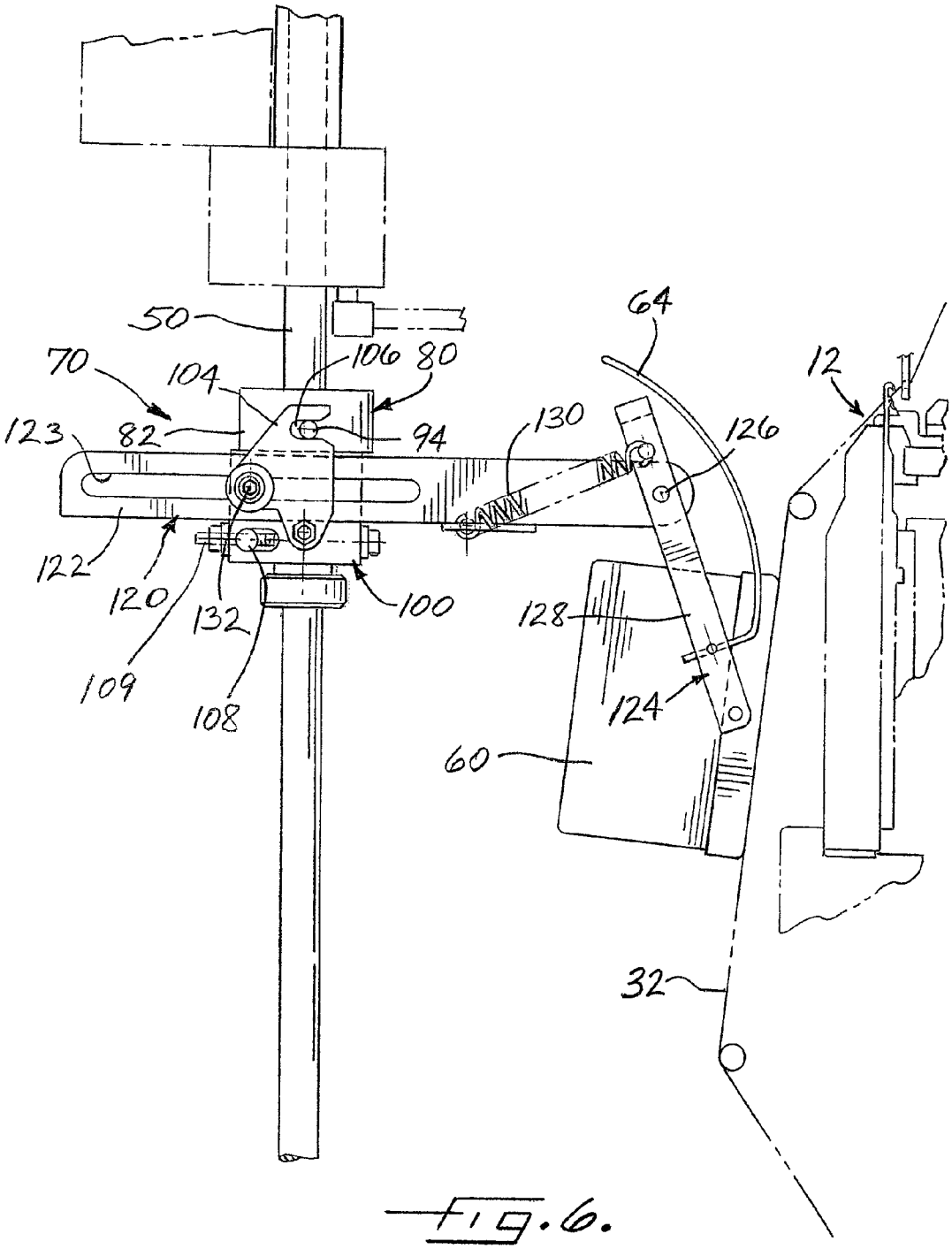
FIG. 6 is an elevation of the fabric scanner and mounting arrangement in its normal position.
Figure 7:
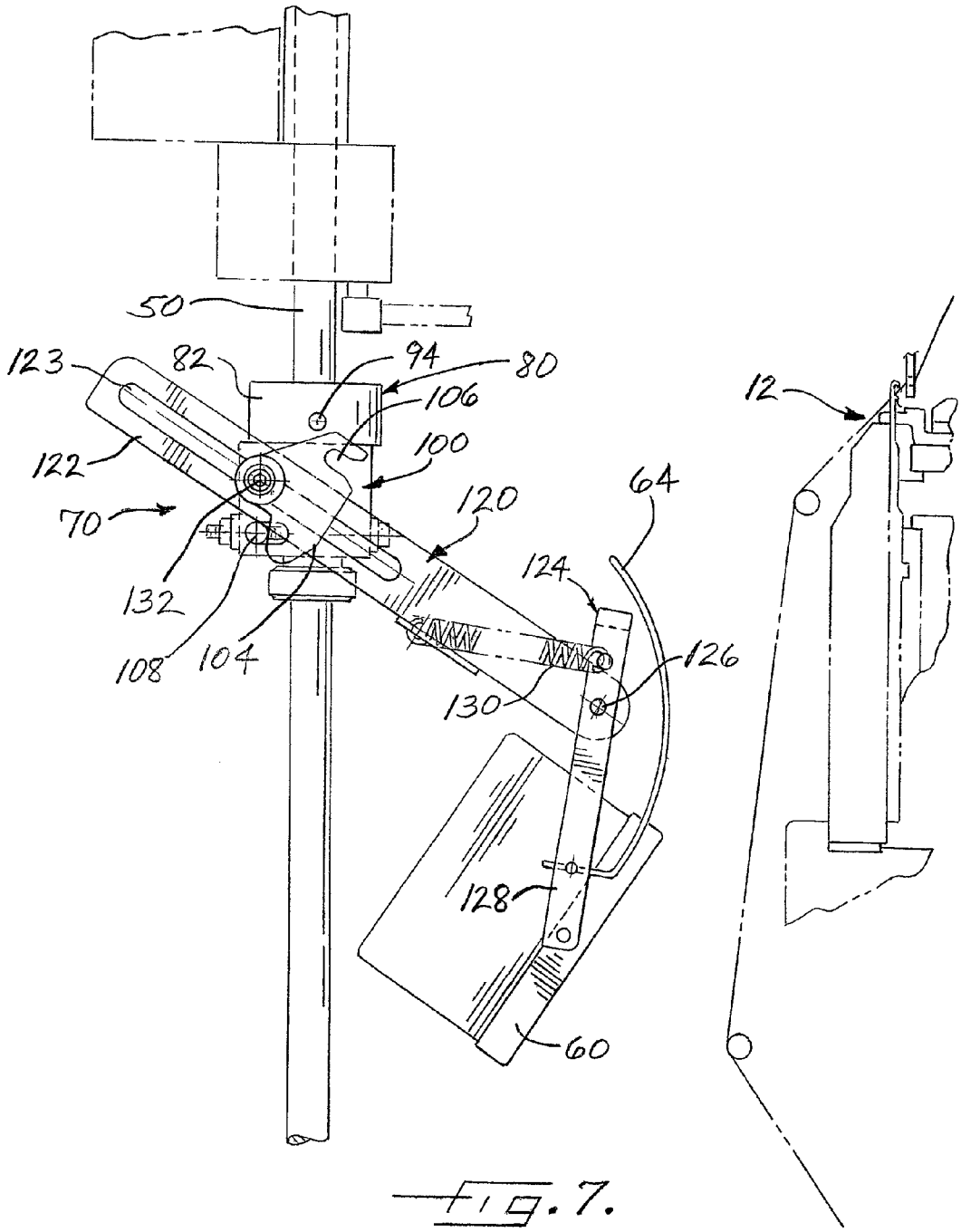
FIG. 7 is a view similar to FIG. 6, showing the mounting arrangement having broken away in response to excessive force exerted on the scanner.

The first bar 122 of the mounting arm 120 is secured to the revolving section 100 in such a manner that the first bar is able to pivot relative to the revolving section about a pivot pin 132 that passes through a generally horizontally extending aperture in the revolving section 100. As further described below, the first bar 122 is normally held such that it is generally perpendicular to the axis of the support shaft 50 as shown in FIG. 6. In this position, the scanner 60 is in contact with the inner surface of the fabric tube 32. The first bar 122 also includes an elongate slot 123 for the fastener that secures the first bar to the revolving section 100, which allows the position of the first bar to be adjusted to alter the length by which the first bar extends radially out from the support shaft 50. This allows the scanner to be positioned closer to the axis for smaller-diameter fabric tubes 32 or farther from the axis for larger-diameter fabric tubes. The mount 70 includes a break-away feature, as further described below, that allows the first bar 122 to pivot downwardly when the break-away feature for the revolving section 100 has broken away and the revolving section has rotated by a predetermined amount.

The break-away features of the mount 70 are now described. With primary reference to FIGS. 2, 3, 4, and 5, the stationary section 80 comprises a block 82 having a hole extending axially therethrough for receiving the support shaft 50. A set screw 84 is used for fixedly securing the block 82 to the shaft 50. The block 82 includes a pair of apertures 86 extending axially therethrough and spaced on generally opposite sides of the hole for the support shaft 50. Each of the apertures 86 contains a plunger 88 having a nose that extends through the bottom end of the aperture and engages a dimple or recess 102 in an upper surface of the revolving section 100 mounted directly below the block 82. The revolving section 100 includes a hole therethrough for receiving the support shaft 50 so that the revolving section can rotate about the support shaft when it breaks away. A spring 90 is disposed in each aperture 86 for urging the plunger 88 in a direction toward the recess 102. At least an upper end of the aperture 86 is internally threaded, and an externally threaded screw 92 is engaged with the threads for adjusting the amount of force the spring 90 exerts on the plunger 88. Thus, the screws 92 are screwed down to increase the amount of spring force, and hence the threshold moment that must be exerted on the revolving section 100 in order to cause the plungers 88 to be forced to ride up the inclined walls of the recesses 102 and out of the recesses so as to allow the revolving section to rotate. The screws 92 are backed out of the apertures in order to reduce the spring force and hence the threshold moment at which the revolving section breaks away.

Figure 2:
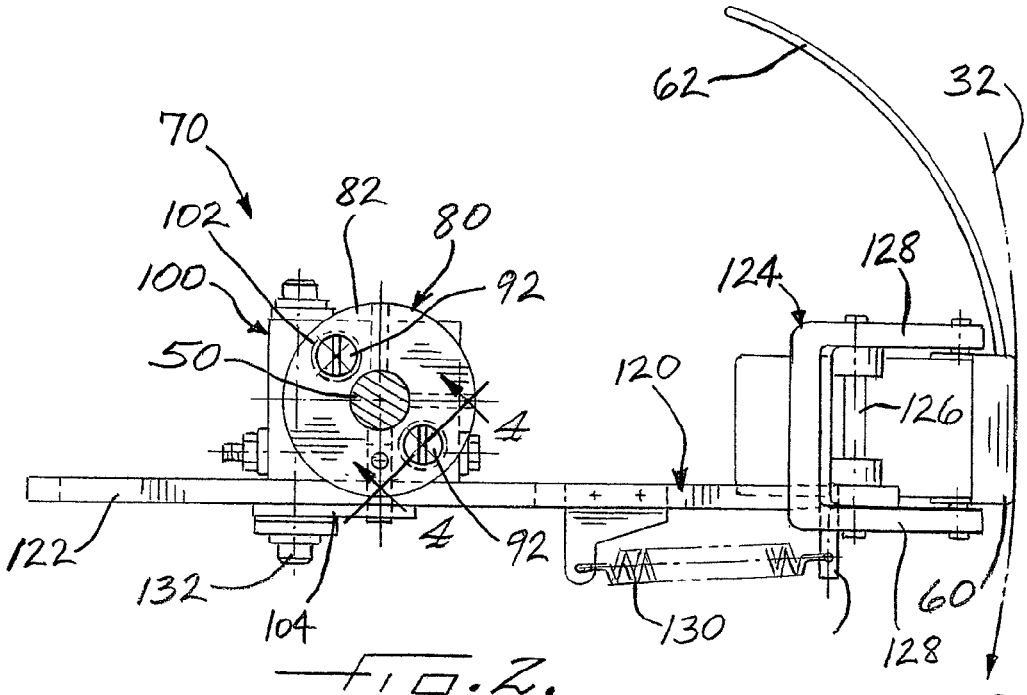
FIG. 2 is a top view of the fabric scanner and its mounting arrangement as seen along the direction indicated by line 2-2 in FIG. 1, in accordance with one embodiment of the invention, showing the scanner in its normal position for scanning fabric.
Figure 3:
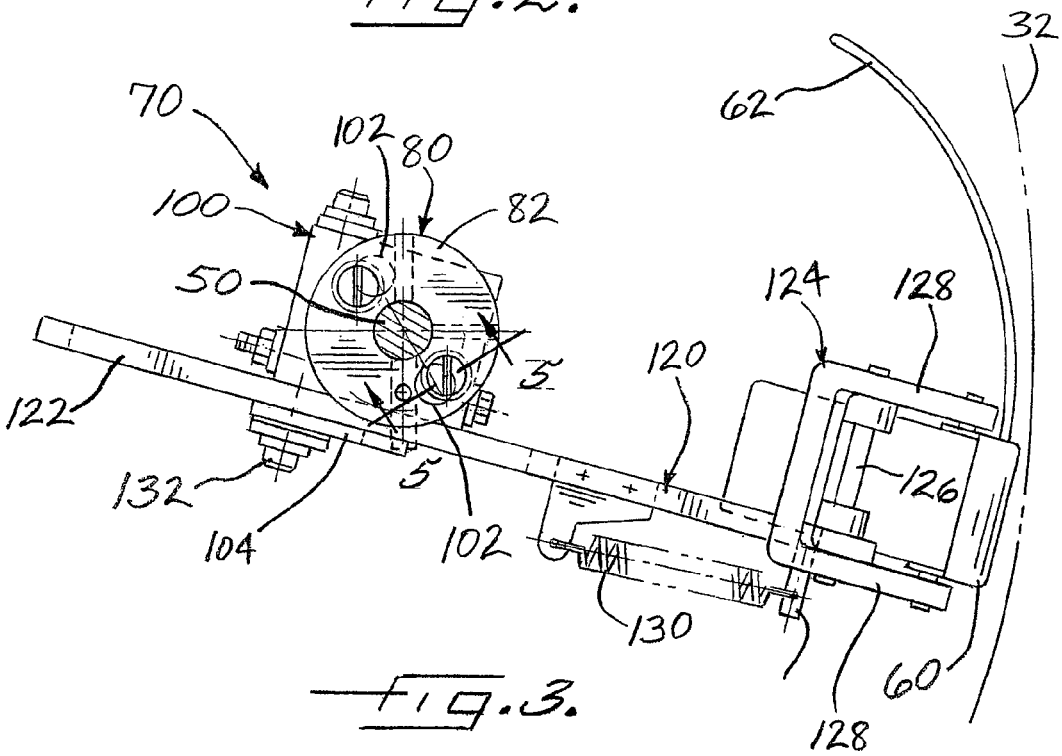
FIG. 3 is a view similar to FIG. 2, showing the mounting arrangement having broken away in response to excessive force exerted on the scanner.

FIG. 2 shows a top view of the mount 70 in its normal position for holding the scanner 60 against the inner surface of the fabric tube 32. The spring-loaded plungers 88 are engaged in the recesses 102 of the revolving section. If the fabric tube 32 snags on the scanner 60 and exerts enough force on the scanner in the circumferential direction so as to exceed the threshold moment for the revolving section, then the plungers will be unseated from the recesses 102 and the revolving section 100 will be free to rotate about the support shaft 50 as shown in FIG. 3.

This rotational movement of the revolving section 100 also allows the mounting arm 120 for the scanner to break away when a predetermined amount of rotation of the revolving section has occurred. This is explained now with primary reference to FIGS. 6 and 7. A latch 104 is fixedly mounted on the first bar 122 and includes a portion that extends upwardly above the first bar and defines a latch slot 106 that extends in a generally circumferential direction relative to the support shaft 50. The latch slot 106 is open at an edge of the latch 104 that extends generally axially relative to the support shaft 50. A latch pin 94 is fixedly secured to the block 82 of the stationary section 80 and projects generally radially outwardly therefrom and is engaged in the latch slot 106 when the mounting arm 120 is in its normal position as in FIG. 6. As long as the spring-loaded plungers 88 of the stationary section 80 are engaged in the recesses 102 of the revolving section 100, the latch pin 94 remains engaged in the latch slot 106 and thus the mounting arm 120 is held in its normal position in which the fabric scanner is against the inner surface of the fabric tube 32. However, after the revolving section 100 has broken away and begins to rotate as previously described, the latch 104 begins to move with the revolving section, in a direction to cause the latch pin 94 to relatively move within the latch slot 106 toward the open side of the latch slot. When the revolving section 100 has rotated far enough to cause the latch pin 94 to exit the latch slot 106, the mounting arm 120 is then free to pivot downwardly about the pivot pin 132. The amount by which the mounting arm 120 can pivot downwardly is limited by a stop 108 (FIGS. 6 and 7) secured to the revolving section 100. The position of the stop 108 advantageously is adjustable by an adjustment mechanism 109, for adjusting how much the mounting arm can pivot downwardly (see FIG. 7).

The amount of rotation of the revolving section 100 required to cause the latch pin 94 to exit the latch slot 106 can be designed into the mount 70 by suitably configuring the latch 104 and pin 94.

From the foregoing description, it is apparent that the mount 70 for the scanner 60 has two different break-away mechanisms that operate sequentially. A first break-away mechanism, which includes the spring-loaded plungers 88 engaged in the recesses 102 of the revolving section 100, allows the scanner to move circumferentially when a predetermined amount of moment is exerted on the revolving section 100 through the mounting arm 120, so that the scanner can move circumferentially with the fabric tube 32 if a defect of the fabric causes the fabric to snag on the scanner. A second break-away mechanism, which includes the latch pin 94 engaged in the latch slot 106 of the latch 104, allows the scanner to move axially downwardly when a predetermined amount of rotational movement of the revolving section 100 has occurred, so that the scanner can move axially with the fabric tube if a defect causes the fabric to snag on the scanner.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A circular knitting machine, comprising:

a circular knitting unit operable to knit fabric in the form of a fabric tube that descends from the circular knitting unit and rotates about a vertical machine axis defined by the knitting unit;

a fixed support shaft generally aligned with the machine axis and extending downward through an interior of the knitting unit and through an interior of the fabric tube;

a fabric scanner disposed against an inner surface of the fabric tube for detecting defects in the fabric;

a mounting arm, the fabric scanner being supported on one end of the mounting arm; and a break-away mount mounted on the support shaft and connected to the mounting arm, the break-away mount being structured and arranged to hold the scanner in a fixed location during normal operation, and to break away to allow the mounting arm to rotate about a generally vertical axis when a force exerted on the mounting arm exceeds a threshold level such that the scanner can move with the rotating fabric tube.

2. The circular knitting machine of claim 1, wherein the break-away mount comprises a revolving section and a stationary section, the mounting arm being fixed to the revolving section so as to rotate therewith when the break-away mount breaks away, the stationary section being rigidly affixed to the support shaft, the revolving section being rotatable relative to the stationary section about the generally vertical axis, the revolving section being restrained from rotating relative to the stationary section by a first break-away mechanism, wherein if sufficient force is exerted on the scanner in the rotational direction the first break-away mechanism breaks away such that the revolving section is free to rotate about the generally vertical axis.

3. The circular knitting machine of claim 2, wherein the first break-away mechanism comprises one or more spring-biased plungers mounted on one of the stationary and revolving sections, each plunger being biased by a spring force such that an end of the plunger engages a corresponding recess in the other of the stationary and revolving sections, a periphery of each recess being formed as a ramped surface, whereby the first break-away mechanism breaks away when sufficient force is exerted on the scanner in the rotational direction to overcome the spring force biasing each plunger such that the end of each plunger rides up the ramped surface and out of the corresponding recess whereupon the revolving section is free to rotate.

4. The circular knitting machine of claim 2, wherein the mounting arm is prevented from pivoting relative to the revolving section by a second break-away mechanism structured and arranged to allow a predefined amount of rotational movement of the revolving section relative to the stationary section before the second break-away mechanism releases and allows the mounting arm to pivot about a non-vertical axis.

5. The circular knitting machine of claim 4, wherein the mounting arm comprises a two-bar linkage, a first bar of the linkage being connected to the revolving section, a second bar of the linkage being pivotally connected to the first bar and the scanner being mounted on the second bar.

6. The circular knitting machine of claim 5, wherein the first bar is connected to the revolving section by an adjustable connection so that the first bar can be adjusted radially for accommodating fabric tubes of different diameters.

7. The circular knitting machine of claim 5, further comprising a spring mechanism that urges the second bar to pivot relative to the first bar so as to press the scanner against the inner surface of the fabric tube.

8. The circular knitting machine of claim 4, wherein the second break-away mechanism comprises a latch and a pin.

9. The circular knitting machine of claim 8, wherein the latch is affixed to one of the revolving and stationary sections and the pin is affixed to the other of the revolving and stationary sections, the latch having a slot in which the pin is engaged to prevent the mounting arm from pivoting about the non-vertical axis, the latch and pin being arranged such that when the revolving section breaks away and begins to rotate, the pin relatively moves within the slot until said predefined amount of rotational movement is exceeded such that the pin comes out of the slot, the mounting arm then being free to pivot about the non-vertical axis.

10. The circular knitting machine of claim 4, further comprising a stop member for limiting how far the mounting arm can pivot about the non-vertical axis.

11. The circular knitting machine of claim 10, wherein the stop member is adjustable in position for adjusting how far the mounting arm can pivot about the non-vertical axis.

12. A break-away mount for a fabric scanner in a circular knitting machine, the circular knitting machine having a fixed support shaft that extends vertically down through an interior of a fabric tube being knitted, the break-away mount comprising:

a stationary section structured and arranged to be rigidly affixed to the support shaft;

a revolving section engaged with the stationary section so as to be rotatable about a generally vertical axis relative to the stationary section;

a mounting arm for the fabric scanner, the mounting arm being coupled with the revolving section; and a first break-away mechanism connecting the revolving section to the stationary section and restraining the revolving section from rotating relative to the stationary section during normal operation, the first break-away mechanism being structured and arranged such that if sufficient force is exerted on the scanner in the rotational direction the first break-away mechanism breaks away such that the revolving section is free to rotate about the generally vertical axis;

wherein the mounting arm is prevented from pivoting relative to the revolving section by a second break-away mechanism structured and arranged to allow a predefined amount of rotational movement of the revolving section relative to the stationary section before the second break-away mechanism releases and allows the mounting arm to pivot about a non-vertical axis.

13. The break-away mount of claim 12, wherein the first break-away mechanism comprises one or more spring-biased plungers mounted on one of the stationary and revolving sections, each plunger being biased by a spring force such that an end of the plunger engages a corresponding recess in the other of the stationary and revolving sections, a periphery of each recess being formed as a ramped surface, whereby the first break-away mechanism breaks away when sufficient force is exerted on the scanner in the rotational direction to overcome the spring force biasing each plunger such that the end of each plunger rides up the ramped surface and out of the corresponding recess whereupon the revolving section is free to rotate.

14. The break-away mount of claim 12, wherein the second break-away mechanism comprises a latch and a pin.

15. The break-away mount of claim 14, wherein the latch is affixed to one of the revolving and stationary sections and the pin is affixed to the other of the revolving and stationary sections, the latch having a slot in which the pin is engaged to prevent the mounting arm from pivoting about the non-vertical axis, the latch and pin being arranged such that when the revolving section breaks away and begins to rotate, the pin relatively moves within the slot until said predefined amount of rotational movement is exceeded such that the pin comes out of the slot, the mounting arm then being free to pivot about the non-vertical axis.

16. The break-away mount of claim 15, further comprising a stop member for limiting how far the mounting arm can pivot about the non-vertical axis.

17. The break-away mount of claim 16, wherein the stop member is adjustable in position for adjusting how far the mounting arm can pivot about the non-vertical axis.

18. The break-away mount of claim 12, wherein the mounting arm comprises a two-bar linkage, a first bar of the linkage being connected to the revolving section, a second bar of the linkage being pivotally connected to the first bar and the scanner being mounted on the end of the second bar.

19. The break-away mount of claim 18, wherein the first bar is connected to the revolving section by an adjustable connection so that the first bar can be adjusted radially for accommodating fabric tubes of different diameters.

20. The break-away mount of claim 18, further comprising a spring mechanism that urges the second bar to pivot relative to the first bar so as to press the scanner against the inner surface of the fabric tube.

21. A break-away mount for mounting a scanner to a generally vertical support shaft in a circular knitting machine, the break-away mount comprising:

a mounting arm for supporting the scanner at one end of the mounting arm;

a revolving section coupled to the other end of the mounting arm;

a first break-away mechanism coupling the revolving section to the support shaft, the first break-away mechanism normally preventing rotation of the revolving section relative to the support shaft so as to keep the scanner in a generally fixed position, the first break-away mechanism being structured and arranged to break away and allow rotation of the revolving section relative to the support shaft when a force exerted on the mounting arm exceeds a threshold force level, such that the scanner is allowed to move in a rotational direction about the support shaft; and a second break-away mechanism coupling the mounting arm to the revolving section, the second break-away mechanism normally preventing pivoting of the mounting arm relative to the revolving section, the second break-away mechanism being structured and arranged to break away and allow pivoting of the mounting arm about a non-vertical axis only after the first break-away mechanism has broken away and the revolving section has rotated by more than a threshold amount of rotation.

* * * * *